US008161779B2

(12) United States Patent
Bergmann et al.

(10) Patent No.: US 8,161,779 B2
(45) Date of Patent: Apr. 24, 2012

(54) LOCK FOR A SLIDING DOOR

(75) Inventors: Carsten Bergmann, Bremen (DE); Dirk Wefer, Bremen (DE); Peter Altenburg, Velbert (DE)

(73) Assignees: raumplus GmbH & Co. KG, Bremen (DE); Steinbach & Vollmann GmbH & Co. KG, Heiligenhaus (DE)

( * ) Notice: Subject to any disclaimer, the term of this patent is extended or adjusted under 35 U.S.C. 154(b) by 0 days.

(21) Appl. No.: 12/555,295

(22) Filed: Sep. 8, 2009

(65) Prior Publication Data

US 2010/0229609 A1 Sep. 16, 2010

(30) Foreign Application Priority Data

Sep. 12, 2008 (DE) ..... 10 2008 047 112

(51) Int. Cl.
*E05B 65/08* (2006.01)
*E05B 9/08* (2006.01)

(52) U.S. Cl. ..... 70/97; 70/99; 70/100; 70/370; 70/451; 292/337; 292/DIG. 46; 292/DIG. 53; 292/DIG. 64

(58) Field of Classification Search ..... 70/100, 70/370, 451, 95–99, DIG. 60, DIG. 63; 292/337, 292/DIG. 46, DIG. 53, DIG. 64
See application file for complete search history.

(56) References Cited

U.S. PATENT DOCUMENTS 1,933,865 A * 11/1933 Martinek ..... 70/97
2,253,496 A * 8/1941 Cordrey et al. ..... 292/182
2,668,319 A * 2/1954 Keys et al. ..... 292/336.3
2,701,157 A * 2/1955 Le Bon, III ..... 292/113
2,769,330 A * 11/1956 O'Connell ..... 70/97
2,789,852 A * 4/1957 Eads ..... 292/110
(Continued)

FOREIGN PATENT DOCUMENTS

AT 5 02 155 A1 1/2007
(Continued)

OTHER PUBLICATIONS

German Search Report issued in corresponding German Application No. 10 2008 047 112.7.

(Continued)

*Primary Examiner* — Lloyd Gall
(74) *Attorney, Agent, or Firm* — Laurence P. Colton; Smith Risley Tempel Santos LLC

(57) ABSTRACT

A lock for a sliding door (14), with a lock case (24) for receiving a lock cylinder (30), the lock cylinder (30) being arranged in a recess (36) of the lock case (24) such that, in order to lock the lock (22), a bolt (28) of the lock case (24) is brought into engagement with a striking plate (26) of the lock (22) by a rotationally actuable driver (32) of the lock cylinder (30). The lock (22) has at least one support part (38, 40) which is arranged laterally on the lock case (24) in the region of the recess (36) to support the lock cylinder (30). A further characteristic relates to the securing of the lock against removal and for this purpose, the or each support part (38, 40) is fastened to the lock case (24) by retaining pins (60), a lock cylinder screw (58) for fastening the lock cylinder (30) to the lock case (24) being in engagement with the or each retaining pin (60) to prevent removal of the support parts (38, 40) and of the retaining pins (60).

18 Claims, 4 Drawing Sheets

U.S. PATENT DOCUMENTS

| | | | | | |
|---|---|---|---|---|---|
| 2,821,849 | A | | 2/1958 | Schweitzer | |
| 3,046,776 | A | * | 7/1962 | Marotto et al. | 70/97 |
| 3,126,727 | A | * | 3/1964 | Dillard et al. | 70/97 |
| 3,594,031 | A | * | 7/1971 | Ford | 292/140 |
| 3,666,309 | A | | 5/1972 | Zarzycki | |
| 3,702,549 | A | * | 11/1972 | Solovieff et al. | 70/134 |
| 3,740,979 | A | * | 6/1973 | Crepinsek | 70/139 |
| 4,296,619 | A | * | 10/1981 | Widen | 70/451 |
| 4,456,290 | A | * | 6/1984 | Gross et al. | 292/337 |
| 4,489,577 | A | * | 12/1984 | Crepinsek | 70/452 |
| 4,688,406 | A | * | 8/1987 | Horgan, Jr. | 70/100 |
| 4,741,186 | A | * | 5/1988 | Martin | 70/100 |
| 5,092,144 | A | * | 3/1992 | Fleming et al. | 70/95 |
| 6,196,034 | B1 | * | 3/2001 | Diebold et al. | 70/95 |
| 6,679,533 | B1 | * | 1/2004 | Bruner et al. | 292/346 |
| 6,945,572 | B1 | * | 9/2005 | Hauber | 292/97 |
| 2004/0040356 | A1 | * | 3/2004 | Su | 70/370 |
| 2008/0168813 | A1 | * | 7/2008 | Smith et al. | 70/370 |
| 2009/0241611 | A1 | * | 10/2009 | Brisco et al. | 70/95 |

FOREIGN PATENT DOCUMENTS

| | | | | |
|---|---|---|---|---|
| DE | 43 00 810 | A1 | | 7/1994 |
| DE | 10103970 | A1 | | 8/2002 |
| DE | 202 20 206 | U1 | | 3/2003 |
| DE | 10229162 | B4 | * | 5/2003 |

OTHER PUBLICATIONS

European Patent Office search report on related application (Jun. 20, 2011).

* cited by examiner

Fig. 4
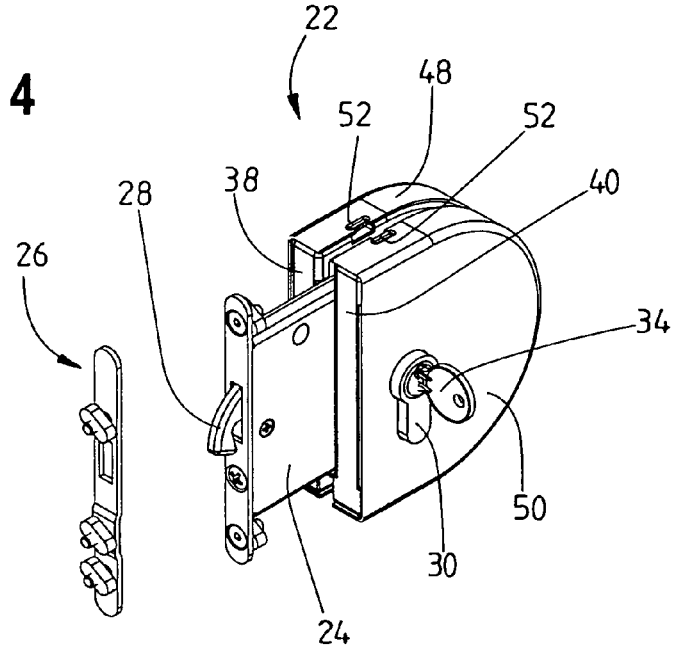
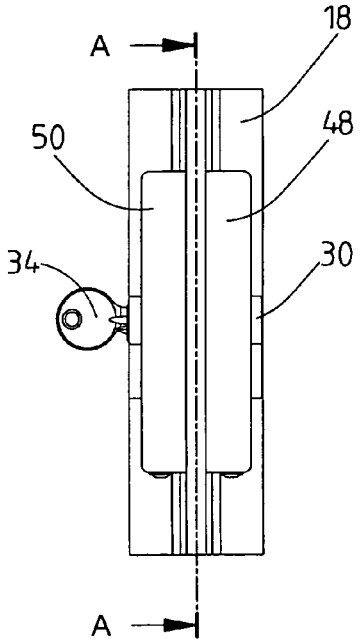
Fig. 5
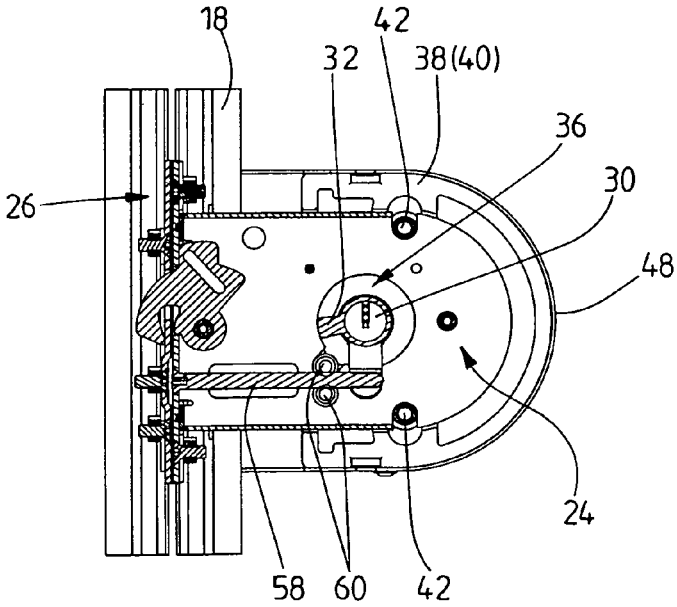
Fig. 6

LOCK FOR A SLIDING DOOR

STATEMENT OF RELATED APPLICATIONS

This application is based on and claims the benefit under 35 USC 119(a)-(d) or (f), or 365(b) of German Patent Application No. DE 10 2008 047 112.7 having a filing date of 12 Sep. 2008, which is incorporated herein in its entirety by this reference

BACKGROUND OF THE INVENTION

1. Technical Field

The invention relates to a lock for a sliding door, with a lock case for receiving a lock cylinder, wherein the lock cylinder is arranged in a recess of the lock case in such a manner that, in order to lock the lock, a bolt of the lock case can be brought into engagement with a striking plate of the lock by means of a rotationally actuable driver of the lock cylinder.

2. Prior Art

Various configurations of locks of this type are basically known from practice. However, these conventional locks are generally not suitable for installing in sliding doors because the sliding door profiles or fillings have only very small dimensions or material thicknesses. Irrespective thereof, however, there is a need to lock sliding doors, in particular if said sliding doors are part of a room-dividing element.

BRIEF SUMMARY OF THE INVENTION

Taking this as the starting point, the invention is based on the object of developing locks of the type mentioned at the beginning, in particular with regard to installing them in sliding doors. Furthermore, it is an object of the invention to make proposals regarding the locking of sliding doors.

A lock according to the invention for achieving said object is a lock, in particular for a sliding door, with a lock case for receiving a lock cylinder, wherein the lock cylinder is arranged in a recess of the lock case in such a manner that, in order to lock the lock, a bolt of the lock case can be brought into engagement with a striking plate of the lock by means of a rotationally actuable driver of the lock cylinder, characterized in that the lock has at least one support part which is arranged laterally on the lock case in the region of the recess in order to support the lock cylinder. According thereto, the lock has at least one support part which is arranged laterally on the lock case in the region of the recess in order to support the lock cylinder. The lock cylinder is therefore at least partially, but preferably substantially held by the support part and is not or is preferably only insubstantially held by the lock case. This makes it possible to use an essentially commercially available profile cylinder in a sliding door, since lock cases for sliding doors have only a very small depth.

According to a preferred development of the invention, a support part is arranged on both sides of the lock case in order to support the lock cylinder. A particularly stable and secure support of the lock cylinder can thereby be ensured.

A further particular characteristic can be for the width of the lock case to correspond to the width of the driver of the lock cylinder. Therefore, in a different manner than otherwise customary, the lock case is not deeper than the driver, and therefore a lock cylinder can be used with a customary driver in a sliding door. The recess preferably has larger dimensions than the cross section of the lock cylinder in such a manner that the driver of the lock cylinder is entirely rotatable within the recess.

The or each support part can be secured on the lock cylinder by retaining means, in particular retaining pins. This involves a particular detail which is also considered to be capable of protection independently of the remaining features of the lock and for which independent protection is claimed. The particular characteristic is that removal of the support parts is prevented in conjunction with a lock cylinder screw.

For a visually attractive appearance, the or each support part can be covered by a cover. In order to be able to fit the lock to sliding doors having different filling thicknesses, the length of the retaining means can correspond to the thickness of a filling of the sliding door. A further particular characteristic can involve the lock cylinder being lockable on both sides.

In addition to protection being claimed for the lock, it is also claimed for a sliding door arrangement with a lock according to the invention. In this case, preferably two leaves of a sliding door are arranged displaceably in a common (identical) plane, one leaf of the sliding door being assigned the striking plate and the other leaf of the sliding door being assigned the remaining parts of the lock. In a preferred embodiment of the invention, the lock case is arranged such that it is partially bonded into the frame, and is concealed in the region outside the frame by means of covers.

Further advantageous refinements and particular characteristics can furthermore be derived from the drawing and the description.

BRIEF DESCRIPTION OF THE DRAWINGS

A preferred exemplary embodiment of the invention is described below with reference to the drawing, in which:

FIG. 4 shows a lock in a schematic, perspective illustration.

FIG. 5 shows a side view of the lock,

FIG. 6 shows a vertical section through the lock along the section line A-A in FIG. 5.

DETAILED DESCRIPTION OF PREFERRED EMBODIMENTS

Figure 1:
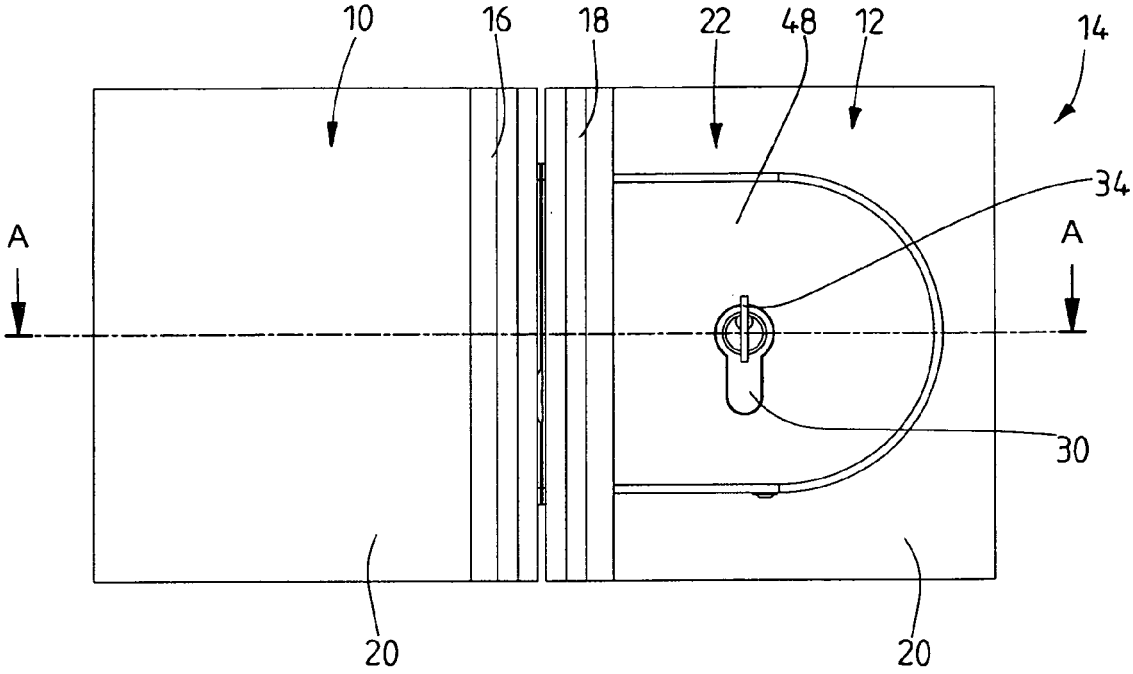
FIG. 1 shows a side view of a sliding door arrangement in the region of a lock.

FIG. 1 shows a sliding door arrangement in a side view. Two leaves 10, 12 of a sliding door 14, which leaves are displaceable in a common, identical vertical plane, are illustrated. The leaves 10, 12 of the sliding door 14 each have a customary frame, of which, in the present case, only the vertical frame profiles 16, 18 are shown, and a filling 20. The filling may be a sheetlike element made of a wood material, plastic, metal, glass or the like. Fillings 20 which comprise a combination of the abovementioned materials are also conceivable.

Figure 2:
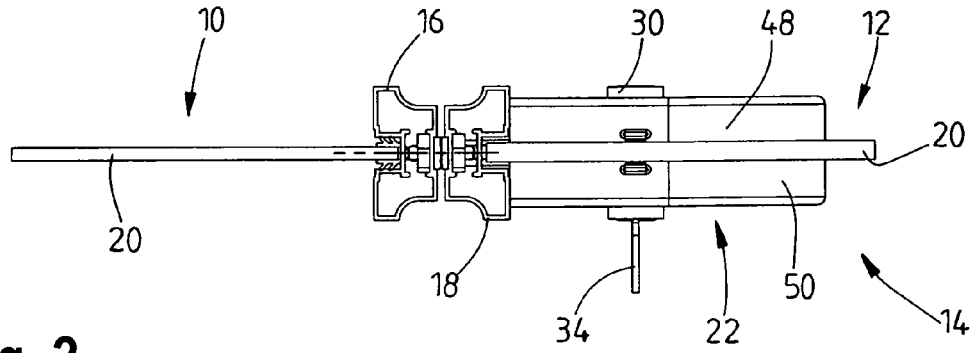
FIG. 2 shows a horizontal section through the sliding door arrangement above the lock.
Figure 3:
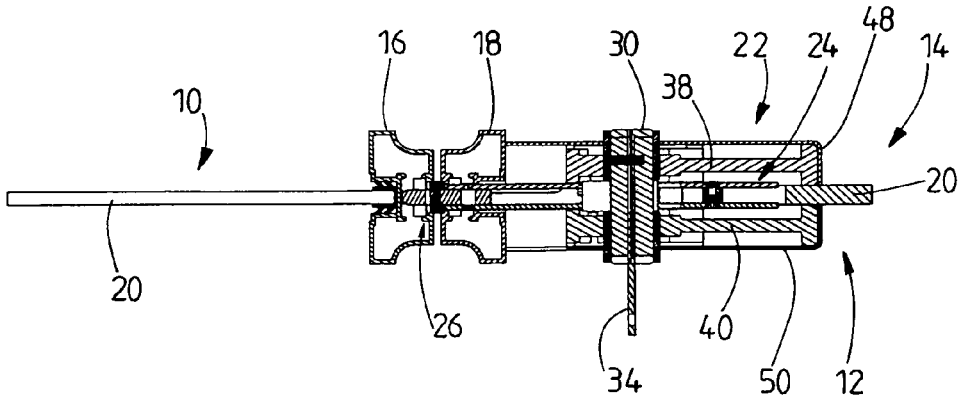
FIG. 3 shows a horizontal section along the section line A-A in FIG. 1.

The two leaves 10, 12 of the sliding door 14 can be locked in place in the closed position shown in FIGS. 1 and 2 by means of a lock 22. The lock 22 is distinguished by a particularly flat constructional shape. In addition, the lock 22 can be matched to different fillings 20 having a differing thickness.

The lock 22 comprises a lock case 24 and a striking plate 26 which are each arranged in the region of the frame profiles 16, 18 on the two leaves 10, 12 such that the leaves 10, 12 can be locked in place by engagement of a bolt 28 of the lock case 24 with the striking plate 26. In this case, the bolt 28 of the lock case 24 is actuable by a lock cylinder 30, in particular a profile cylinder, which can be inserted into the lock case 24. For this purpose, the lock cylinder 30 has a rotationally actuable driver 32 which is actuable in a known manner by rotation of a key 34 which can be inserted into the lock cylinder 30.

A particular characteristic of the lock cylinder 30 is that the latter has a particularly short constructional shape. Otherwise, however, it very substantially corresponds to a standard cylinder. FIG. 2 shows that the lock cylinder 30 has substantially the same length as the corresponding depth of the frame profiles 16, 18. The lock cylinder 30 therefore substantially does not protrude over outer planes formed by the frame profiles 16, 18.

A further particular characteristic of the lock cylinder 30 is that latter, despite the short length, can be locked from both sides. This enables the sliding door 14 to be used, for example, in a room divider and to be lockable from both sides.

In order to receive the lock cylinder 30, the lock case 24 has a recess 36 into which the lock cylinder 30 can be inserted. However, a particular characteristic is that the recess 36 has larger dimensions than customary. A further particular characteristic is that the width of the lock case 24 is equivalent to the width of the driver 32 of the lock cylinder 30, i.e. the lateral sides of the driver 32 are in the same plane of the side surfaces of the lock case 24. This results in the driver 32 being entirely rotatable within the recess 36 and not projecting over the recess 36 into the lock case 24.

In order to support the lock cylinder 30, two support parts 38, 40 are provided, one on each side of the lock case 24. The support parts 38, 40 are placed against the sides of the lock case 24 and each have a recess 42, the design and dimensions of which correspond to the lock cylinder 32. In this manner, the lock cylinder 30 is supported on the support parts 38, 40 which, in turn, are fastened to the lock case 24, for example by means of screws 68 which are connected through corresponding bores 46 in the lock case 24 and the support parts 38, 40 to threaded bushes 44.

Figure 7:
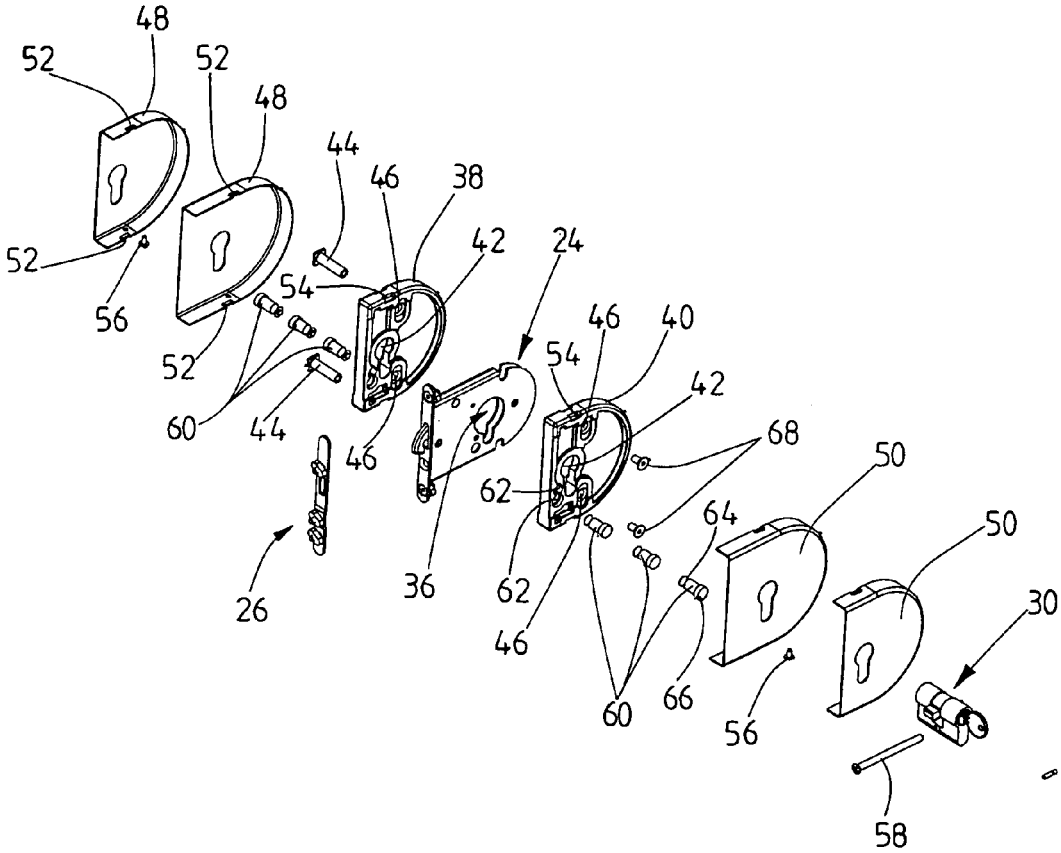
FIG. 7 shows the lock in a schematic exploded illustration.

The support parts 38, 40 are covered to the outside by covers 48, 50. The covers 48, 50 can be arranged adjoining the frame profiles 16, 18 and can enclose the support profiles 38, 40 laterally and on the exposed edges. The covers 48, 50 are fastened to the support parts 38, 40 by engagement of projections 52, which are formed on the upper side and the lower side of the covers 48, 50, into a corresponding depression 54 on the upper side of the support parts 38, 40, and by a screw connection in the region of the lower side of the covers 48, 50 and of the support parts 38, 40. FIG. 7 shows a screw 56 for this purpose.

A further particular characteristic relates to a securing device for the lock 22 and the leaves 10, 12 of the sliding door 14. The lock cylinder 30 is fastened to the lock case 24 in a manner known per se by a lock cylinder screw 58. In this case, the lock cylinder screw 58 is screwed into the lock case 24 from the end side of the leaf 12. Retaining pins 60 which run at an angle to the screw passage and at least partially intersect therewith are arranged in the region of the screw passage of the lock cylinder screw 58. The retaining pins 60 are inserted in mutually parallel planes from both sides through openings 62 in the support parts 38, and in the lock case 24 and, in the region of the intersection with the screw passage, have a groove 64 in which the lock cylinder screw 58 engages preferably with a form fit. In this manner, the retaining pins 60 are secured by the screwed-in lock cylinder screw 58 against being pulled out. Furthermore, on the outer side, the retaining pins 60 have a thickened portion 66 which has larger dimensions than the corresponding openings 62 in the support part 38, 40. This prevents the support parts 38, 40 from being removed from the retaining pins 60 without previous removal of the lock cylinder screw 58 and of the retaining pins 60.

The above-described arrangement results in the closed sliding door 14 being secured. After the lock 22 is locked, the lock cylinder 30 cannot be removed since the lock cylinder screw 58 is not accessible. Although the covers 48, 50 can be removed from the support parts 38, 40, the support parts 38, 40 cannot be removed from the lock case 24, since said support parts are secured by engagement of the lock cylinder screw 58 with the retaining pins 60. An opening of the leaves 10, 12 of the sliding door 14 is therefore not possible without destruction.

It can be seen from FIG. 4 that the covers 48, 50 and the retaining pins 60 are provided in different dimensions for matching to the width of the frame profiles 16, 18 and to the thickness of the filling 20. It also can be seen that bolt 28 has a hook configuration that, as can be better seen in FIG. 6, allows the bolt 28 to inhibit the movement of the lock case 24 relative to the striking plate 26 by a hooked engagement with the striking plate 26.

In the present exemplary embodiment, a respective support part 38, 40 is arranged on both sides of the lock case 24. However, it goes without saying that the use of an only one-sided support part 38, 40 is also conceivable.

LIST OF REFERENCE NUMBERS

10 Leaf
12 Leaf
14 Sliding door
16 Frame profile
18 Frame profile
20 Filling
22 Lock
24 Lock case
26 Striking plate
28 Bolt
30 Lock cylinder
32 Driver
34 Key
36 Recess
38 Support part
40 Support part
42 Recess
44 Threaded bush
46 Bore
48 Cover
50 Cover
52 Projection
54 Depression
56 Screw
58 Lock cylinder screw
60 Retaining pin
62 Opening
64 Groove
66 Thickened portion
68 Screw

What is claimed is:

1. A lock for use in connection with a sliding door (14), the lock comprising:

a lock cylinder (30) having a rotationally actuable driver (32);

a lock case (24) for receiving the lock cylinder (30), the lock case (24) having a recess (36), and a bolt (28) having a hook configuration, the lock case (24) being in a common plane with the sliding door (14);

a striking plate (26);

at least one support part (38, 40) arranged laterally on the lock case (24) in the region of the recess (36) to support the lock cylinder;

at least one retaining pin (60), wherein the at least one support part (38, 40) is fastenable to the lock case (24) by the at least one retaining pin (60); and a lock cylinder screw (58) for fastening the lock cylinder (30) to the lock case (24), wherein the lock cylinder (30) is arranged in the recess (36) of the lock case (24) such that, in order to lock the lock (22), the bolt (28) of the lock case (24) is brought into engagement with the striking plate (26) of the lock (22) by the rotationally actuable driver (32) of the lock cylinder (30), wherein the hook configuration of the bolt (28) allows the bolt (28) to be in a hooked engagement with the striking plate (26) and to inhibit the movement of the lock case (24) relative to the striking plate (26) in the common plane, and wherein the lock cylinder screw (58) is in engagement with the at least one retaining pin (60) in order to prevent removal of the at least one support part (38, 40) and of the at least one retaining pin (60) by means of the lock cylinder screw (58), thereby securing the lock cylinder (30) and the at least one retaining pin (60) against being pulled out of the lock case (24).

2. The lock according to claim 1, wherein the at least one support part (38, 40) is arranged on both sides of the lock case (24) in order to support the lock cylinder (30).

3. The lock according to claim 1, wherein the lock case (24) has a width that is equivalent to the width of the driver (32) of the lock cylinder (30) such that lateral sides of the driver (32) extend in a plane with side surfaces of the lock case (24).

4. The lock according to claim 1, wherein the recess (36) has larger dimensions than a cross-sectional region of the lock cylinder (30) in such a manner that the driver (32) of the lock cylinder (30) is entirely rotatable within the recess (36).

5. The lock according to claim 1, wherein the lock case further comprises a screw passage for the lock cylinder screw, and the at least one retaining pin (60) is at an angle to and at least partially intersects with the lock cylinder screw (58), wherein the lock cylinder screw (58) engages the at least one retaining pin (60) with a form fit.

6. The lock according to claim 1, further comprising a cover (48, 50) for covering the or each support part (38, 40).

7. The lock according to claim 5, wherein the at least one retaining pin (60) has a length that is equivalent to a thickness of a filling (20) in the sliding door (14) on which the lock is used.

8. The lock according to claim 1, wherein the lock cylinder (30) can be locked on both sides.

9. The lock according to claim 2, further comprising a cover (48, 50) for covering the or each support part (38, 40).

10. The lock according to claim 2, wherein the at least one retaining pin has a length that is equivalent to a thickness of a filling (20) in the sliding door (14) on which the lock is used.

11. The lock according to claim 1, whereby the bolt (28) is rotatable out of the lock case (24) and to engage the striking plate (26) and whereby the bolt (28) is rotatable at least partly into the lock case (24) and to disengage the striking plate (26).

12. The lock according to claim 11, wherein the bolt (28) is rotatable around a single axis which is fixed relative to the lock case (24) and oriented perpendicularly to the common plane.

13. A sliding door arrangement comprising a sliding door (14) and a lock (22), the lock comprising:

a lock cylinder (30) having a rotationally actuable driver (32);

a lock case (24) for receiving the lock cylinder (30), the lock case (24) having a recess (36) and a bolt (28) having a hook configuration, the lock case (24) being in a common plane with the sliding door (14);

a striking plate (26);

at least one support part (38, 40) arranged laterally on the lock case (24) in the region of the recess (36) to support the lock cylinder;

at least one retaining pin (60), wherein the at least one support part (38, 40) is fastenable to the lock case (24) by the at least one retaining pin (60); and a lock cylinder screw (58) for fastening the lock cylinder (30) to the lock case (24), wherein the lock cylinder (30) is arranged in the recess (36) of the lock case (24) such that, in order to lock the lock (22), the bolt (28) of the lock case (24) is brought into engagement with the striking plate (26) of the lock (22) by the rotationally actuable driver (32) of the lock cylinder (30), wherein the hook configuration of the bolt (28) allows the bolt (28) to be in a hooked engagement with the striking plate (26) and to inhibit the movement of the lock case (24) relative to the striking plate (26) in the common plane, and wherein the lock cylinder screw (58) is in engagement with the at least one retaining pin (60) in order to prevent removal of the at least one support part (38, 40) and of the at least one retaining pin (60) by means of the lock cylinder screw (58), thereby securing the lock cylinder (30) and the at least one retaining pin (60) against being pulled out of the lock case (24).

14. The sliding door arrangement according to claim 13, wherein the sliding door (14) comprises two leaves (10, 12) that are arranged displaceably in a common plane, one of the leaves (10) having the striking plate (26) attached thereto and the other of the leaves (12) having the lock cylinder (30), the rotationally actuable driver (32), the lock case (24), the bolt (28), and the at least one support part (38, 40) attached thereto, wherein the lock (22) inhibits relative movement of the two leaves (10, 12) in the common plane.

15. The sliding door arrangement according to claim 14, further comprising:

frame profiles (16, 18);

a filling (20); and covers (48, 50), wherein the leaves (10, 12) each have one of the frame profiles (16, 18) and the filling (20), the lock case (24) is arranged such that it is partially bonded into the frame profile (18) of one of the leaves (12) and is concealed in the region outside the frame profile (18) by means of the covers (48, 50).

16. The lock sliding door arrangement according to claim 13, wherein the lock case further comprises a screw passage for the lock cylinder screw, and the at least one retaining pin (60) is at an angle to and at least partially intersects with the lock cylinder screw (58), wherein the lock cylinder screw (58) engages the at least one retaining pin (60) with a form fit.

17. The sliding door arrangement according to claim 13, whereby the bolt (28) is rotatable out of the lock case (24) and to engage the striking plate (26) and whereby the bolt (28) is rotatable at least partly into the lock case (24) and to disengage the striking plate (26).

18. The sliding door arrangement according to claim 17, wherein the bolt (28) is rotatable around a single axis which is fixed relative to the lock case (24) and oriented perpendicularly to the common plane.

* * * * *